US010874926B2

(12) United States Patent
Hurley

(10) Patent No.: US 10,874,926 B2
(45) Date of Patent: Dec. 29, 2020

(54) PRACTICE GOLF CLUB

(71) Applicant: James Hurley, Chevy Chase, MD (US)

(72) Inventor: James Hurley, Chevy Chase, MD (US)

( * ) Notice: Subject to any disclaimer, the term of this patent is extended or adjusted under 35 U.S.C. 154(b) by 0 days.

(21) Appl. No.: 15/955,856

(22) Filed: Apr. 18, 2018

(65) Prior Publication Data

US 2019/0321708 A1 Oct. 24, 2019

(51) Int. Cl.
*A63B 53/04* (2015.01)
*A63B 69/36* (2006.01)

(52) U.S. Cl.
CPC ..... *A63B 69/3632* (2013.01); *A63B 53/0466* (2013.01); *A63B 53/0475* (2013.01); *A63B 53/0433* (2020.08); *A63B 2053/0479* (2013.01); *A63B 2053/0483* (2013.01)

(58) Field of Classification Search
CPC ..... A63B 2053/042; A63B 2053/0425
USPC ..... 473/328, 329
See application file for complete search history.

(56) References Cited

U.S. PATENT DOCUMENTS

| | | | | |
|---|---|---|---|---|
| 1,939,414 | A | 12/1933 | Sametz | |
| 4,343,473 | A | 8/1982 | Laursen | |
| 5,007,643 | A * | 4/1991 | Okumoto | A63B 53/04 473/346 |
| 5,310,189 | A | 5/1994 | Soto | |
| D368,949 | S | 4/1996 | Evans et al. | |
| 5,672,120 | A | 9/1997 | Ramirez et al. | |
| 6,179,723 | B1 | 1/2001 | Evans | |
| 7,118,489 | B1 | 10/2006 | Hubley | |
| 7,544,134 | B1 | 6/2009 | Harmon et al. | |
| 7,896,754 | B1 | 3/2011 | Winters | |
| 8,529,365 | B1 | 9/2013 | Davis | |
| 2006/0252568 | A1 | 11/2006 | Simmons | |
| 2008/0076597 | A1* | 3/2008 | Roach | A63B 53/04 473/342 |
| 2008/0318707 | A1 | 12/2008 | Mergy et al. | |
| 2010/0248859 | A1 | 9/2010 | Kim et al. | |
| 2010/0331096 | A1* | 12/2010 | Curtis | A63B 53/0466 473/282 |
| 2012/0077611 | A1 | 3/2012 | Lorince | |

FOREIGN PATENT DOCUMENTS

| | | |
|---|---|---|
| DE | 19953680 | 5/2001 |
| KR | 200456864 | 11/2011 |
| WO | 2008046244 | 1/2008 |

OTHER PUBLICATIONS

International Search Report and Written Opinion issued in International Application No. PCT/US19/27738 dated Jul. 3, 2019.

* cited by examiner

*Primary Examiner* — Raeann Gorden
(74) *Attorney, Agent, or Firm* — The Belles Group, P.C.

(57) ABSTRACT

A golf club that is used to practice a golf swing. Specifically, the golf club includes a handle and a head coupled to the handle. The head is formed from a first portion and a second portion that are coupled together. The first portion may be formed of a rigid material and the second portion may be formed of a resilient material. The second portion may comprise bristles or some other soft, pliable, compressible material that will not damage a surface upon contact during swinging the golf club. The golf club head preferably has the same shape as a traditional golf club head of the same type. However, the second portion forms the sole of the head, thereby eliminating the potential for damage to a floor surface during swinging of the golf club.

14 Claims, 8 Drawing Sheets

PRACTICE GOLF CLUB

BACKGROUND

Golf clubs include a clubhead that is typically formed of metal or wood for hitting a golf ball. When a user desires to practice his golf swing, the user typically goes to a driving range to hit golf balls. This can be a time-consuming activity because it requires the user to travel to the driving range facility to perform the task. A user might also go outside to practice his or her swing without actually hitting any golf balls. However, this activity has a tendency to damage the surface upon which the user is practicing his or her swing, and thus users are deterred from practicing their golf swing on their own property. Furthermore, swinging a golf club indoors can cause significant damage to the floor surface and to the golf club. Thus, a need exists for a golf club that enables a user to practice his or her swing indoors or outdoors without damaging the surface upon which the user is standing during such practice.

BRIEF SUMMARY

The present invention is directed to a golf club that is used to practice a golf swing without the risk of damaging the surface upon which the user is standing during practice. Specifically, the golf club includes a handle and a head coupled or integrated to the handle. The head is formed from a first portion and a second portion that are coupled together. The first portion may be formed of a rigid material and the second portion may be formed of a resilient material. The second portion may comprise bristles or some other soft, pliable, compressible material that will not damage a surface upon contact during swinging the golf club. The golf club head preferably has the same shape as a traditional golf club head of the same type. However, the second portion forms the sole of the head, thereby eliminating the potential for damage to a floor surface during swinging of the golf club.

In one aspect, the invention may be a golf club comprising: a handle extending along a longitudinal axis; a head coupled to the handle, the head comprising a face, a rear surface opposite the face, and a peripheral surface extending between the face and the rear surface, the head further comprising: a first portion formed of a rigid material, the first portion having a top end and a bottom end, the top end forming a top portion of the peripheral surface; and a second portion formed of a resilient material, the second portion extending from the bottom end of the first portion and terminating in a distal end that forms an entirety of a bottom portion of the peripheral surface, the bottom portion of the peripheral surface forming a sole of the head.

In another aspect, the invention may be a golf club comprising: a handle; a head coupled to the handle, the head comprising: a sole and a face, the face extending from a leading edge of the sole to a top edge; a first portion formed of a rigid material and forming a first portion of the face that includes the top edge; and a second portion extending from the first portion, the second portion formed of a resilient material and forming a second portion of the face and the leading edge of the sole.

In yet another aspect, the invention may be a golf club comprising: a handle; a head coupled to the handle, the head comprising a sole, a top end, and a face extending between the sole and the top end, the face having a heel, a toe, and a sweet spot located between the heel and the toe and being spaced apart from the sole and the top end, the head further comprising: a first portion forming the top end of the head and a first portion of each of the heel and the toe of the face; and a second portion extending from the first portion and forming an entirety of the sole of the head, an entirety of the sweet spot of the face, and a second portion of each of the heel and the toe of the face; wherein the first portion of the head is formed from wood or metal and the second portion of the head is formed from a plurality of bristles; and wherein the first and second portions of the head collectively form a shape that corresponds to a shape of a traditional golf club head.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
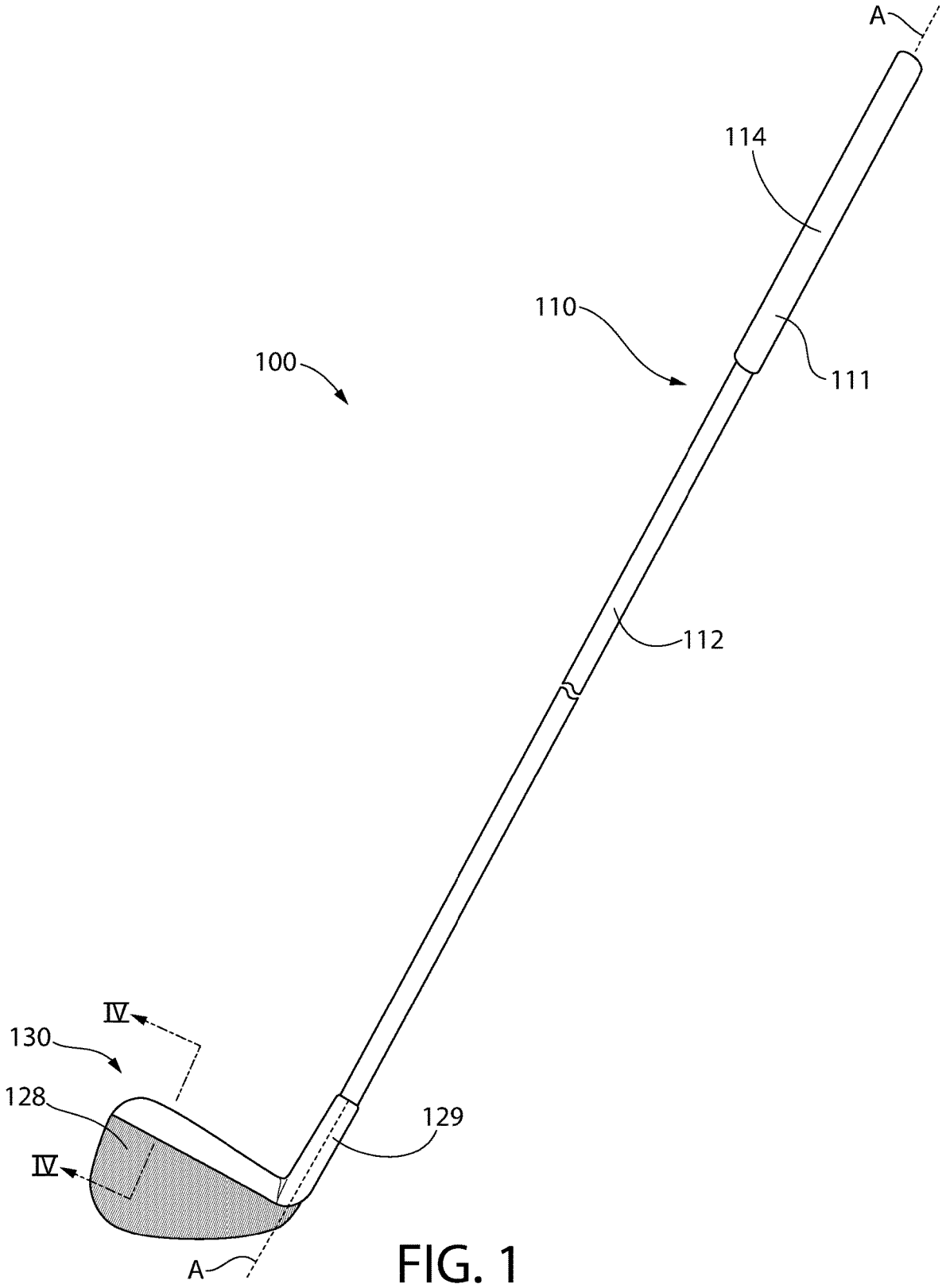
FIG. 1 is a front view of a golf club in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "integrated," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, a golf club 100 is illustrated in accordance with an embodiment of the present invention. The golf club 100 generally comprises a handle 110 and a head 130. The handle 110 is the portion of the golf club 100 that is gripped by a user during swinging of the golf club 110. The handle 110 extends along a longitudinal axis A-A and comprises a grip portion 111 and a shaft portion 112. The handle 110 may be formed of any desired material. Examples of materials that may be used to form the handle 100 include graphite, titanium, and steel (or alloys thereof), although other materials may also be used (i.e., wood, plastic, etc.). In the exemplified embodiment, the grip portion 111 includes a grip member 114. The grip member 114 may be formed from leather, rubber, or the like to enhance a user's grip on the handle 110 during use of the golf club 100. Specifically, the grip member 114 may prevent slippage of a user's hand on the handle 110 during swinging of the golf club 100. The handle 110 is similar in structure, material, mass/weight, and the like to the handles on conventional golf clubs.

The head 130 of the golf club 100 is the portion of the golf club 100 that may contact a surface on which a user is standing during swinging of the golf club 100. In a traditional sense, the head of a golf club is used to hit a golf ball and the head may contact the surface upon which the golf ball lies during swinging of the golf club to hit the golf ball. However, the golf club 100 of the exemplified embodiment is not intended for making contact with golf balls. Rather, the golf club 100 of the exemplified embodiment is intended for practicing swinging of the golf club in various different indoor and outdoor environments without causing damage to the golf club or to the surface on which the golf club 100 is being swung. This is accomplished because the lower portion of the head 130 is formed of a resilient material (i.e., bristles, compressible material, pliable material, sponge-like material, or the like), which will be discussed in greater detail below. Perfecting a user's swing is a very important component in improvement of a user's golf score and practicing swinging a golf club without making contact with a golf ball can improve a user's golfing abilities. Of course, the golf club 100 may be used to hit a golf ball if so desired, although because the sweet spot of the golf club is formed of the resilient material as described below, the golf club 100 will not be capable of hitting a golf ball a significant distance. In some embodiments, the invention may be directed to the head 130 of the golf club 100 only.

Despite the fact that the lower portion of the head 130 is formed of a resilient material, the head 130 still has the general shape of a traditional golf club. For example, where the golf club is an iron (as with the golf club 100), the head 130 may have a pear-like or truncated oval-like shape as with traditional irons. Moreover, where the golf club is a driver or hybrid club, the head may have a round, a pear, an extended back, a square, or the like shape as with traditional drivers/hybrids.

In some embodiments the golf club 100 may have the same mass (or weight) as a traditional golf club of the same type (iron, wood, hybrid, etc.). Examples of a standard mass for the heads of iron-type golf clubs is as follows: 3-iron: 235-245 g 4 i: 242-252 g; 5-iron: 249-259 g; 6-iron: 256-266 g; 7-iron: 263-273 g; 8-iron: 270-280 g 9-iron: 277-287 g; Pitching Wedge: 284-294 g; driver: 190-210 g; 3-wood: 200-220 g; 5-wood: 210-230 g; 3-hybrid: 230-250 g. Thus, in some embodiments the head 130 of the golf club 100 has a mass within these noted ranges, with a tolerance of approximately 5%, so that the golf club 100 has the feel of a standard or more conventional golf club.

Thus, when a user swings the golf club 100, the golf club 100 feels like a standard or traditional golf club in every sense, despite the fact that the head 130 is not formed entirely of metal or wood but is instead formed at least partially of the resilient material. Thus, as a user practices his or her swing using the golf club 100 of the present invention, it feels to the user as if he or she is swinging a traditional golf club formed entirely of a rigid material such as metal or wood rather than one that is formed partially of a resilient material.

The head 130 comprises a hosel (or neck) 129 and a clubhead 128. In certain embodiments, the hosel 129 may be a hollow structure into which the shaft 112 of the handle 110 may be inserted to couple the handle 110 to the head 130. Of course, other techniques for coupling the handle 110 and the head 130 may be possible in other embodiments. For example, the handle 110 and the head 130 may be an integral structure in some embodiments. In other embodiments, the handle 110 and the head 130 may be detachable from one another so that various different styles and types of heads may be used with the same handle.

Golf clubs come in different types and styles. Specifically, there are eight irons numbered 2-iron through 9-iron, a pitching wedge, a sand wedge, a putter, woods, and variations called hybrids. In the exemplified embodiment, the head 130 of the golf club 100 has the shape and loft (the angle formed by the intersection of the face of the head and the longitudinal axis A-A of the handle 110) of a typical 9-iron. However, it should be appreciated that the disclosure set forth herein is also applicable to any other type of golf club. Thus, using the techniques described herein, any type of golf club can be manufactured that is designed for taking practice swings indoors or outdoors without damaging the underlying surface upon which the user is standing during taking such practice swings.

Figure 2:
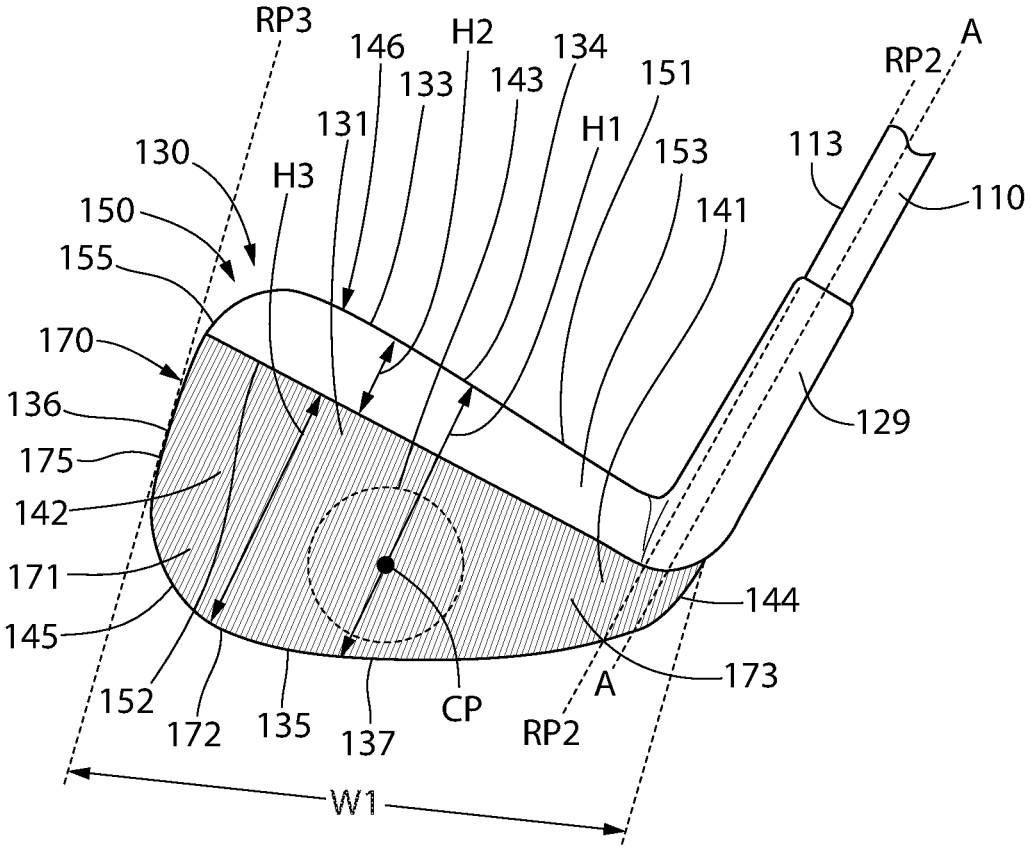
FIG. 2 is a close-up view of a head of the golf club of FIG. 1.
Figure 3:
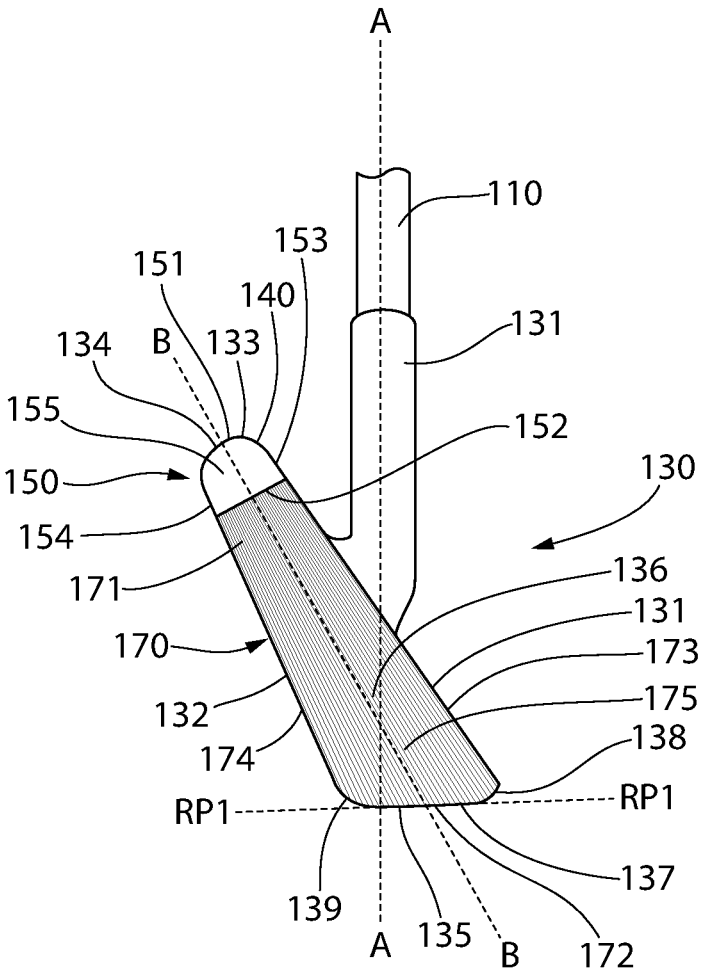
FIG. 3 is a side view of the head of the golf club of FIG. 1.

Referring to FIGS. 2 and 3, the head 130 of the golf club 100 will be further described. The head 130 comprises a face 131 (also referred to as a striking face, a front surface, or a clubface), a rear surface 132 opposite the face 131, and a peripheral surface 133 extending between the face 131 and the rear surface 132. The peripheral surface 133 forms the outer boundary of the head 130 and in the exemplified embodiment is generally U-shaped. In the exemplified embodiment, there are no components protruding from the peripheral surface 133. Thus, the peripheral surface 133 is a smooth and continuous surface that defines the outer bounds of the head 130. The peripheral surface 133 includes a top portion or top end 134, a bottom portion or bottom end 135, and a distal portion 136. The bottom portion 135 of the peripheral surface 133 forms a sole 137 of the head 130. The sole 137 of the head 130 is the bottom-most portion of the head 130 that would contact a ground surface during swinging of the golf club 100.

The sole 137 comprises a leading edge 138 and a trailing edge 139. As will be discussed in more detail below, the sole 137 has a rounded contour in at least one direction. Specifically, in the exemplified embodiment the sole 137 is rounded, and more specifically convex, in a direction moving from a proximal end 144 of the head 130 to the distal portion 136 of the peripheral surface 133 of the head 130. In the exemplified embodiment, the sole 137 is planar in a direction moving from the leading edge 138 to the trailing edge 139. However, in other embodiments the sole 137 may also, or alternatively, be rounded or convex in a direction moving from the leading edge 138 to the trailing edge 139. In the exemplified embodiment, a transition region 145 between the sole 137 and the distal portion 136 of the peripheral surface 133 is rounded and thus the transition region 145 has a radius of curvature. Thus, the sole 137 and the distal portion 136 of the peripheral surface 133 are parts of a continuous, uninterrupted peripheral surface 133 of the head 130. However, the invention is not to be so limited and in other embodiments the transition region 145 may not be rounded but may instead be a sharp corner.

The face 131 of the head 130, which is the surface of the head 130 that contacts a golf ball during golfing in the traditional sense, extends from the leading edge 138 of the sole 137 to a top edge 140. Furthermore, the face 131 comprises a heel 141, a toe 142, and a sweet spot 143 located between the heel 141 and the toe 142. The heel 141 is the portion of the face 131 that is located adjacent to the hosel 131 (and that includes the proximal end 144 of the head 130) and the toe 142 is the portion of the face 131 that is located adjacent to (and that includes) the distal portion 136 of the peripheral surface 133 of the head 130. The heel 141 and the toe 142 extend the full height of the face 131 from the bottom portion 135 or sole 137 to the top portion 134. However, the sweet spot 143 does not similarly extend the full height of the face 131. Rather, the sweet spot 143 is identified by a circular dashed line that is located between the heel 141 and the toe 142 and between the top portion 134 and the sole 137 while being spaced apart from the top portion 134 and the sole 137. Of course, the sweet spot 143 could be an oval region in other embodiments. The sweet spot 143 is a well-known term of art identifying the precise region of the face 131 where a golf ball should contact the face 131 for optimal results.

In the exemplified embodiment, the face 131 has a width W1 measured from the proximal end 144 to the distal portion 136 and a height H1 measured from the bottom portion 135 to the top portion 134. The sweet spot 143 is approximately centered along the width W1 of the face 131 and thus a center-point CP of the sweet spot 143 it is approximately equidistant from the proximal end 144 and the distal portion 136. However, the sweet spot 143 is generally not similarly centered along the height H1 of the face 131. Rather, the center-point CP of the sweet spot 143 is located closer to the sole 137 (or bottom portion 135 of the peripheral surface 133) than to the top portion 134 of the peripheral surface 133. A ratio of the distance between the top portion 134 of the peripheral surface 133 and the center-point CP of the sweet spot 143 to the distance between the bottom portion 135 of the peripheral surface 133 (or the sole 137) and the center-point CP of the sweet spot 143 is between 1.3:1 and 1.8:1, more specifically 1.4:1 and 1.7:1, and more specifically 1.5:1 and 1.6:1. (the distances being measured along a line that is parallel to the longitudinal axis A-A of the handle 110). In some embodiments, the ratio of the distance between the top portion 134 of the peripheral surface 133 and the center-point CP of the sweet spot 143 to the distance between the bottom portion 135 of the peripheral surface 133 and the center-point CP of the sweet spot 143 may be greater than 1.5:1, greater than 2:1, or greater than 2.5:1. Thus, the center-point CP of the sweet spot 143 is approximately equidistant to the proximal end 144 of the head 130 and the distal portion 136 of the peripheral surface 133 and is closer to the bottom portion 135 of the peripheral surface 133 (or the sole 137) than to the top portion 134 of the peripheral surface 133.

The head 130 of the golf club 100 comprises a first portion 150 and a second portion 170. The first portion 150 is formed of a rigid material, such as a material that is typically used to form a head of a golf club, and the second portion 170 is formed of a resilient material. For example, the first portion 150 may be formed of wood or metal. Examples of metals that may be used for the first portion include titanium, stainless steel, tungsten, aluminum, carbon graphite, zinc, combinations thereof, and alloys thereof. However, the first portion 150 may also be formed of a hard-plastic material, such as without limitation polypropylene, polyethylene terephthalate, polyethylene, polyvinyl chloride, polystyrene, or the like in other embodiments. The first portion 150 is merely a rigid material in some embodiments, although wood and metal are preferable.

The first portion 150 of the head 130 comprises a top end 151 and a bottom end 152. The top end 151 of the first portion 150 forms the top portion 134 of the peripheral surface 133 of the head 130. More specifically, in the exemplified embodiment the top end 151 of the first portion 150 forms the entirety of the top portion 134 of the peripheral surface 133 of the head 130. Furthermore, the first portion 150 forms a first portion 153 of the face 131 of the head 130, a first portion 154 of the rear surface 132 of the head 130, and a first portion 155 of the distal portion 136 of the peripheral surface 133 of the head 130.

The second portion 170 of the head 130 extends from the bottom end 152 of the first portion 150 of the head 130 and terminates at a distal end 172. The second portion 170 of the head 130 is formed of a resilient material, which may be bristles, a compressible material, a pliable material, a sponge-like material, or the like so that when the second portion 170 contacts a surface it does not damage the surface. The distal end 172 of the second portion 170 forms an entirety of the bottom portion 135 of the peripheral surface 133, and hence also the entirety of the sole 137 of the head 130. Furthermore, the second portion 170 of the head 130 forms a second portion 173 of the face 131 of the head 130, a second portion 174 of the rear surface 132 of the head 130, and a second portion 175 of the distal portion 136 of the peripheral surface 133 of the head 130. Thus, the first and second portions 150, 170 collectively form each of the face 131, the rear surface 132 and the distal portion 136 of the head 130.

In the exemplified embodiment, a reference plane RP3 on which the second portion 175 of the distal portion 136 of the peripheral surface 133 of the head 130 lies, which is formed by the second portion 170 of the head 130, does not intersect the first portion 155 of the distal portion 136 of the peripheral surface 133 of the head 130. A portion of the first portion 155 may also lie on the reference plane RP3, but it is not intersected by the reference plane RP3. However, in other embodiments the first portion 155 may protrude slightly from the second portion 175 and therefore be intersected by the reference plane RP3.

In the exemplified embodiment, the second portion 170 of the head 130 forms the entirety of the sweet spot 143 of the face 131 of the head 130. Thus, the first portion 150 of the head 130 does not form any part of the sweet spot 143 of the face 131 because the first portion 150 of the head 130 only forms a small part of the overall height H1 of the head 130. Moreover, in the exemplified embodiment the second portion 170 of the head 130 forms the entirety of the transition region 145 between the sole 137 and the distal portion 136 of the peripheral surface 133 of the head 130. Thus, the first portion 150 of the head 130 does not form any part of the rounded transition region 145 between the sole 137 and the distal portion 136 of the peripheral surface 133 of the head 130.

In the embodiment of FIGS. 2 and 3, the second portion 170 of the head comprises a plurality of bristles 171. The bristles 171 may be formed from a brush material such as polybutylene terephthalate, nylon, polyester, polypropylene, Teflon, animal hair, or from a rubber material such as thermoplastic elastomer or the like. In some embodiments, the plurality of bristles 171 may include a combination of brush material and rubber material forming different specific portions of the head 130. Specifically, the plurality of bristles 171 may include rubber bristles that form the second portion 173 of the heel 141 and the toe 142 of the face 131 and brush-type bristles that form the portion of the face 131 extending between the heel 141 and the toe 142. Thus, the brush-type bristles will be used to form the sweet spot 143. The invention is not to be particularly limited by the types of bristles used for the various parts of the head 130 and face 131. Thus, in some embodiments only a single type of bristle may be used and in other embodiments multiple types of bristles may be used. Different types of bristles may include bristles being formed of different materials. Alternatively, different types of bristles may include bristles that are formed of similar or the same materials, but that have at least one different characteristic. Such a characteristic may be selected from thickness, taper, dimensions, color, structure (i.e., monofilament, spiral, core-sheath, etc.), waviness, curliness, or the like. The bristles 171 are preferably not formed of metal, but rather are formed of a soft material that will not damage an underlying surface (such as the flooring inside of a building) when the golf club 100 is swung.

The first and second portions 150, 170, when viewed collectively, have a shape that corresponds to a shape of a traditional golf club head of a similar type. Thus, the first portion 150 does not form the shape of the head 130 by itself, but only when the first and second portions 150, 170 are taken together does the shape of the head 130 get formed. Thus, in the invention described herein, the bristles 171 do not protrude from a bottom surface of the head 130, but rather the bristles 171 form a part of the head 130. This distinction is important, because it results in the golf club 100 having an identical shape to a traditional golf club, except that a portion of the head 130 is formed from the second material 170, which may be bristles 171.

In order to form the head 130 having a shape that corresponds to the shape of a traditional golf club head, the plurality of bristles 171 have varying lengths measured from the bottom end 152 of the first portion 150 of the head to the distal ends 172 of the bristles 171. Thus, the plurality of bristles 171 have a plurality of different lengths. As a result of the various lengths of the bristles 171, the bottom portion 135 of the peripheral surface 133 (i.e., the sole 137) has a rounded contour in at least one direction, as noted above. Specifically, the round shape of the sole 137 is created by using bristles 171 having different lengths. Thus, the bristles 171 along the heel 141 have the shortest length and the length of the bristles 171 progressively increases from the heel to the transition region 145, where the length of the bristles 171 decreases until the distal portion 136 of the peripheral surface 133. The lengths of the bristles 171 may be modified in other ways, but in some preferable embodiments the bristles 171 do not all have the same length to thereby create the sole 137 with the rounded, or convex, contour. In an alternative embodiment, the first portion 150 of the head 130 may have a varying height and the height of the bristles 171 may all be the same, thereby achieving a similar visual effect.

In the exemplified embodiment, the sole 137 is planar when extending from the leading edge 138 to the trailing edge 139. However, in other embodiments the sole 137 may be convex in the direction between the leading and trailing edges 138, 139. Either way, as best seen in FIG. 3, a bottom-most portion of the sole 137 formed by the distal ends 172 of the bristles 171 lies in a reference plane RP1 and the second portion 170 of the head 130 (i.e., the plurality of bristles 171) extends along an axis B-B that is oblique to the reference plane RP1. The exact angle between the axis B-B and the reference plane RP1 may change depending on the loft of the face 131, but regardless of the exact loft the axis B-B is oblique to the reference plane RP1 in the exemplified embodiment.

As noted above, in the exemplified embodiment the first portion 150 of the head 130 forms the first portion 153 of the face 131 of the head 130 and the second portion 170 of the head 130 forms the second portion 173 of the face 131 of the head 130. The first portion 150 of the head 130 forms the first portion 154 of the rear surface 132 of the head 130 and the second portion 170 of the head 130 forms the second portion 174 of the rear surface 132 of the head 130. Moreover, the first portion 150 of the head 130 forms the first portion 155 of the distal portion 136 of the peripheral surface 133 of the head 130 and the second portion 170 of the head 130 forms the second portion 155 of the distal portion 136 of the peripheral surface 133 of the head 130. In some embodiments, the first and second portions 153, 173, 154, 174, 155, 175 of each of the face 131, the rear surface 132 and the distal portion 136 are flush with one another so that the face 131, the rear surface 132 and the distal portion 136 are smooth, continuous surfaces. However, the invention is not to be so limited in all embodiments and it is possible that the second portions 173, 174, 175 may be inwardly offset from the first portions 153, 154, 155 such that the bottom end 152 of the second portion 150 of the head 130 comprises a peripheral portion that surrounds the second portion 170 of the head 130 (see, for example, FIG. 4B).

In the exemplified embodiment, the second portion 170 of the head 130 makes up a greater percentage of the height of the head 130 than the first portion 150 of the head 130. Thus, the first portion 150 of the head 130 has a maximum height H2 measured in a direction parallel to the longitudinal axis A-A of the handle 110 and the second portion 170 of the head 130 has a maximum height H3 measured in a direction parallel to the longitudinal axis A-A of the head 130. The maximum height H3 of the second portion 170 of the head 130 (i.e., of the bristles 171) is greater than the maximum height H2 of the first portion 150 of the head 130.

Stated another way, the head 130 has a main portion 146 located between a reference plane RP2 that is tangent to a front surface 113 of the handle 110 and the distal portion 136 of the peripheral surface 133 of the head 130. Within the main portion 146 of the head 130, the second portion 170 of the head 130 has a minimum height measured along a line parallel to the longitudinal axis A-A of the handle 110 that is equal to or greater than a height of the first portion 150 of the head 130 measured along the same line.

Moreover, the face 131 of the head 130 has a surface area which is the region of the face 131 that is bounded by the peripheral surface 133. In the exemplified embodiment, the second portion 170 of the head 130 forms at least 50% of the surface area of the face 131. More specifically, in some embodiments the second portion 170 of the head 130 forms at least 60% of the surface area of the face 131, and in some embodiments the second portion 170 of the head 130 forms at least 70% of the surface area of the face 131.

Figure 4A:
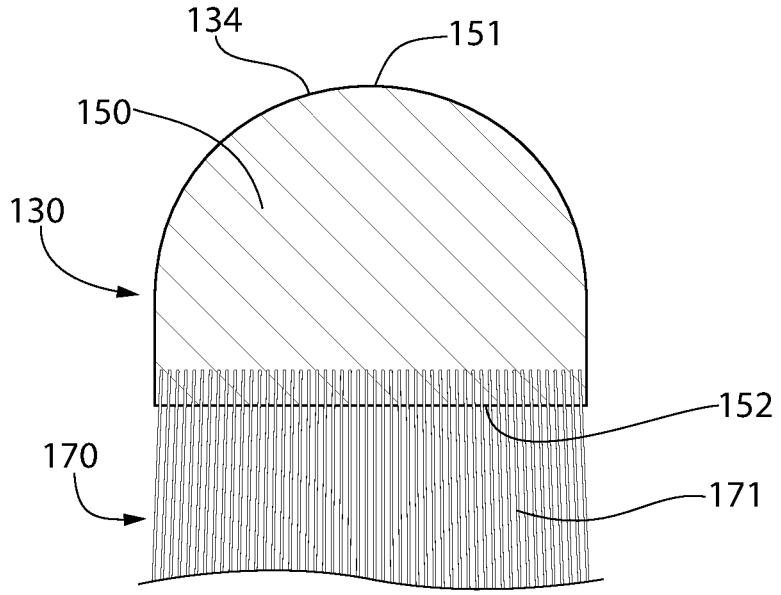
FIG. 4A is a cross-sectional view taken along line IV-IV of FIG. 1 in accordance with one embodiment of the present invention.

Turning to FIG. 4A, a cross-sectional view taken along line IV-IV in FIG. 1 is shown in accordance with one embodiment of the present invention. In this embodiment, the plurality of bristles 171 are connected directly to the first portion 150 of the head 130. This may be achieved using any conventional means, such as staples, adhesive, drilling holes in the first portion 150 and mounting the bristles therein, or the like. In FIG. 4A, the second portion 170 of the head 130 (i.e., the bristles 171) are generally flush with the first portion 150 of the head 130 so that the face 131 of the head 130 is a continuous, planar surface without having any undercuts, ledges, lips, flanges, or the like. Of course, the first portion 150 of the head 130 may protrude slightly from the outer bounds of the second portion 170 of the head 130, thereby forming a lip or the like in alternative embodiments.

Figure 4B:
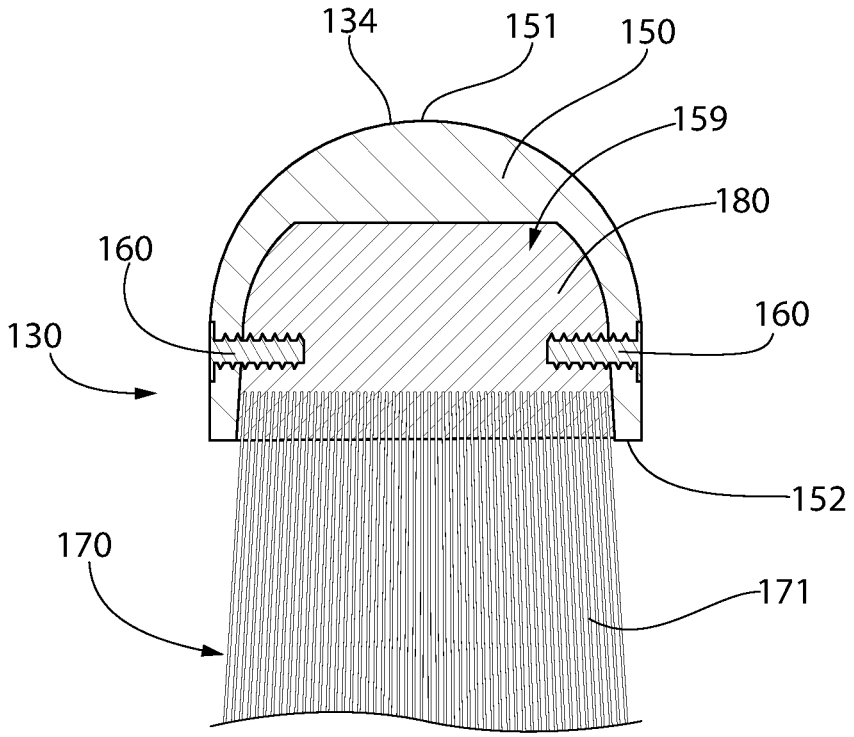
FIG. 4B is a cross-sectional view taken along line IV-IV of FIG. 1 in accordance with another embodiment of the present invention.

FIG. 4B illustrates the same cross-sectional view as FIG. 4A in accordance with an alternative embodiment of the present invention. In this embodiment, the bristles 171 are secured to an insert 180 by any desired means, such as staples, adhesives, or the like. Alternatively, the bristles 171 could extend entirely through openings in the insert 180 so that ends of the bristles 171 on one side of the insert 180 are melted together to form a melt matte that prevents the bristles 171 from being pulled through the holes in the plate. Regardless of how the bristles 171 are coupled to the insert 180, the insert 180 may be coupled to the first portion 150 of the head 130 to indirectly couple the bristles 171 to the first portion 150 of the head 130. In the exemplified embodiment, the first portion 150 of the head 130 has a cavity 159 and the insert 180 nests within the cavity 159. The insert 180 is then coupled to the first portion 150 of the head 130 using hardware 160 such as screws, nails, bolts, or the like. However, the insert 180 could instead be coupled to the first portion 150 of the head 130 using welding, ultrasonic welding, adhesives, or the like. In this embodiment, the bristles 171 may be inwardly offset relative to the first portion 150 of the head 130 as mentioned above.

Thus, FIGS. 4A and 4B, along with the above description, exemplify that there are several ways that the bristles 171 can be coupled to the first portion 150 of the head 130. In some embodiments, the second portion 170 (i.e., bristles or the like) of the head 130 is fixedly coupled to the first portion 150 of the head 130 such that the second portion 170 of the head 130 cannot be readily detached from the first portion 150 of the head 130.

Figure 5:
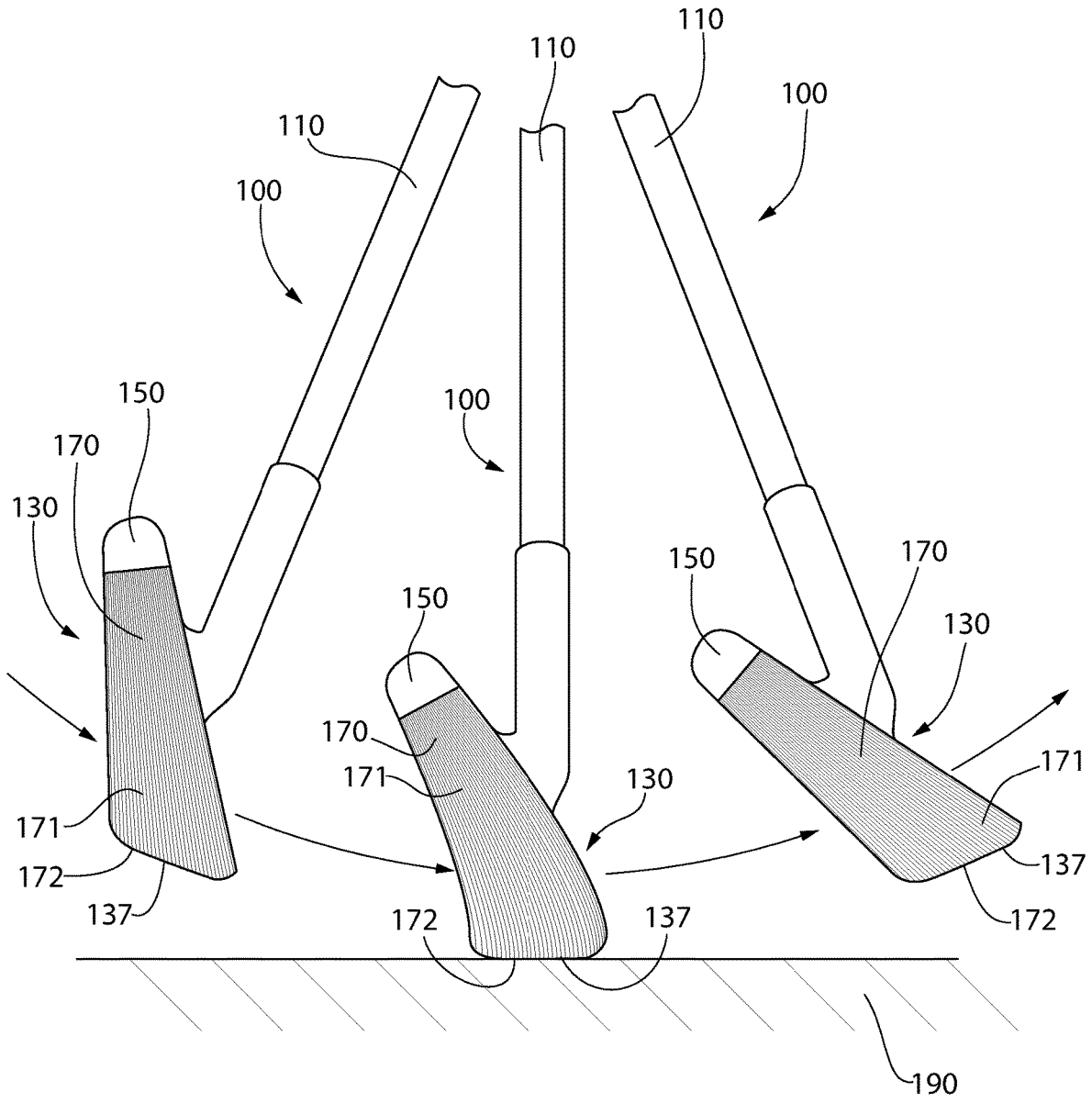
FIG. 5 is a schematic view illustrating a portion of the golf club of FIG. 1 undergoing a swinging motion.

FIG. 5 schematically illustrates the golf club 100 in use to take a practice swing on a surface 190. As can be seen, as the golf club 100 is swung in a traditional manner, the sole 137 formed by the distal ends 172 of the plurality of bristles 171 of the second portion 170 of the head 130 may contact the surface 190 (i.e., the floor of an indoor space such as carpet, hardwood, tile or an outdoor ground surface such as dirt, grass, turf, or the like). Because the second portion 170 of the head 130 is formed from a resilient material (i.e., the bristles 171 in the exemplified embodiment), the second portion 170 of the head 130 will flex and bend slightly as the second portion 170 of the head 130 contacts the surface 190. As the user continues to swing the golf club 100, the second portion 170 of the head 130 will move away from the surface 190 and the bristles 171 return to their initial unbent state. Thus, a user can swing the golf club 100 indoors or outdoors without damaging the floors of the interior space (or the outdoor space) because the only portion of the golf club 100 that contacts the floor is the second portion 170 of the head 130, which is formed of a resilient material, and more specifically bristles 171.

Figure 6:
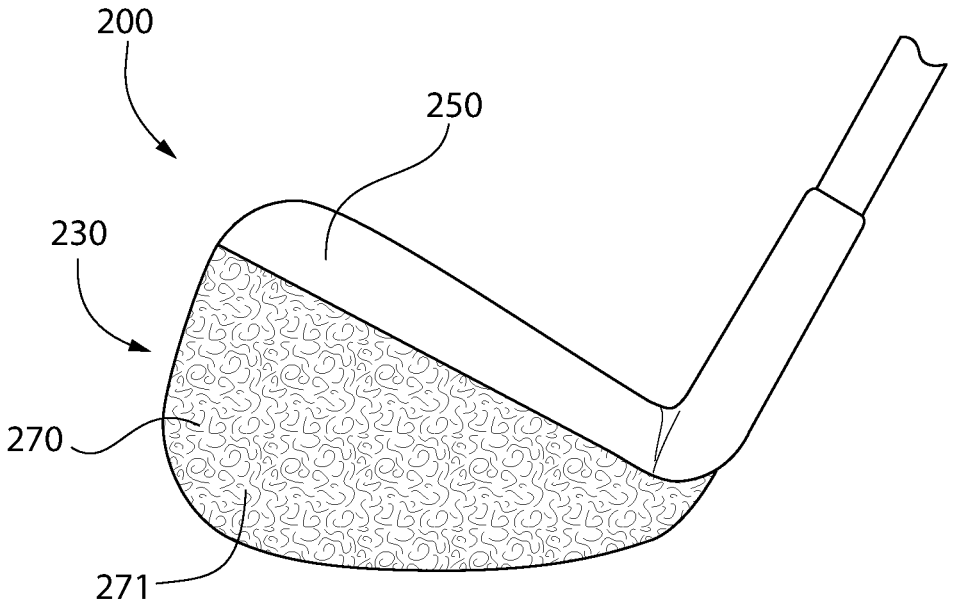
FIG. 6 is a front view of a head of a golf club in accordance with another embodiment of the present invention.
Figure 7:
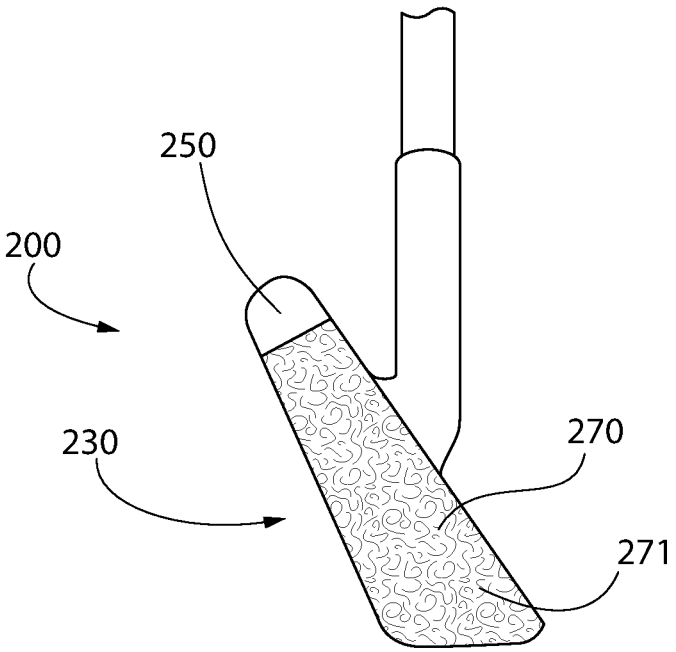
FIG. 7 is a side view of the head of the golf club of FIG. 6.
Figure 8:
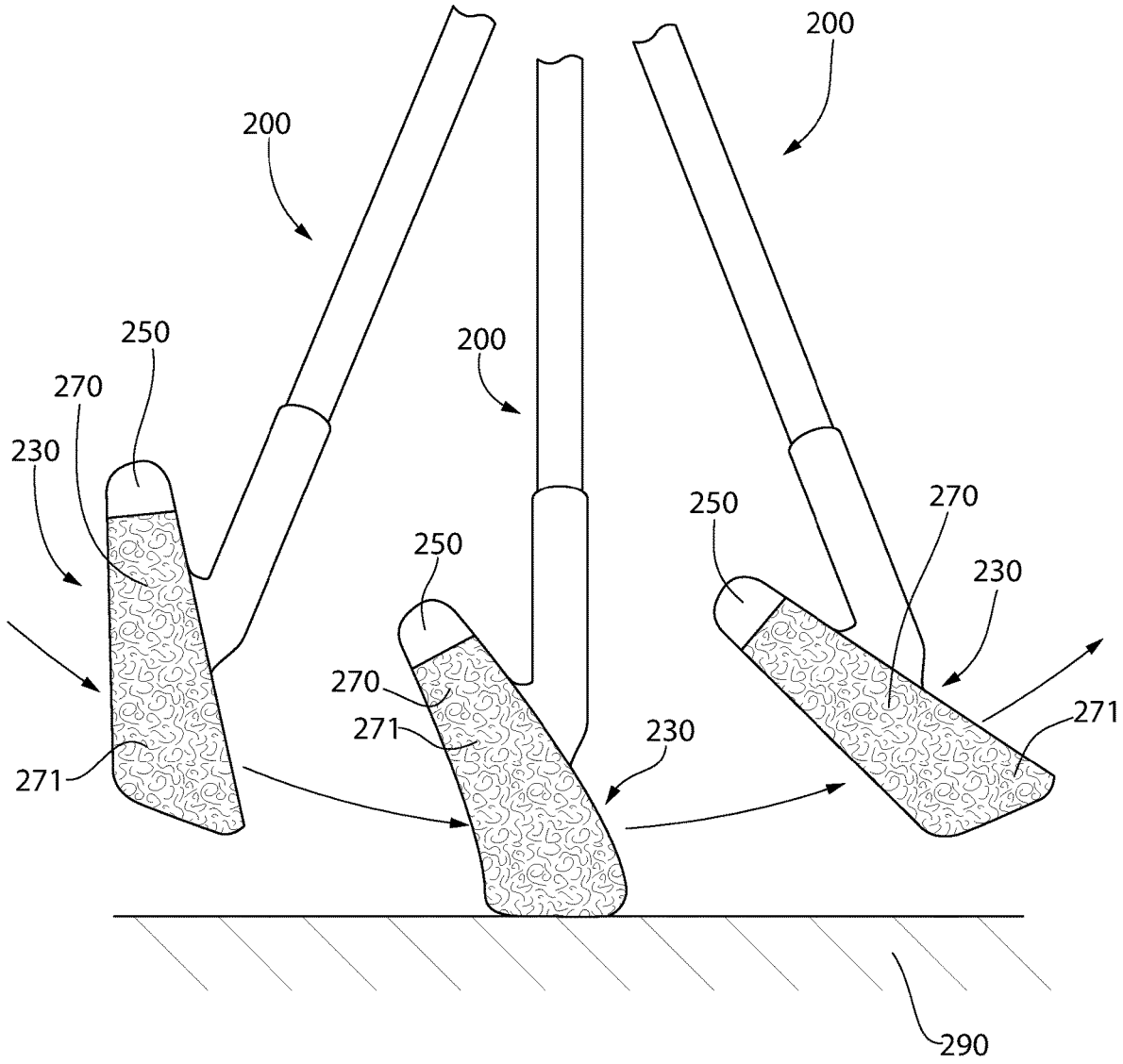
FIG. 8 is a schematic view illustrating a portion of the golf club of FIG. 6 undergoing a swinging motion.

Referring to FIGS. 6-8, a golf club 200 is illustrated in accordance with another embodiment of the present invention. Similar reference numerals will be used to describe the golf club 200 as were used to describe the golf club 100 except that the 200-series of numbers will be used. The features of the golf club 200 that are identical to the golf club 100 will not be described herein, it being understood that the description provided above with reference to the golf club 100 is applicable.

The golf club 200 is identical to the golf club 100 described above except with regard to the material of the second portion 270 of the head 230. Specifically, in this embodiment the second portion 270 of the head 230 is formed of a compressible material 271 rather than bristles. The compressible material 271 may be any material that will compress when pressed against a rigid surface 290 such as a floor or exterior ground surface. Thus, if the compressible material 271 contacts such a surface 290 during swinging of the golf club 200 the compressible material 271 will compress or deform, only to return to its original shape when no longer in contact with the surface 290. Thus, in some embodiments the second portion 270 of the head 230 may comprise a resilient material other than bristles, as described herein. The compressible material 271 may be a compressible foam, a sponge-like material, a soft rubber, or a similar material that will compress as described herein rather than causing damage to the surface 290.

Figure 9:
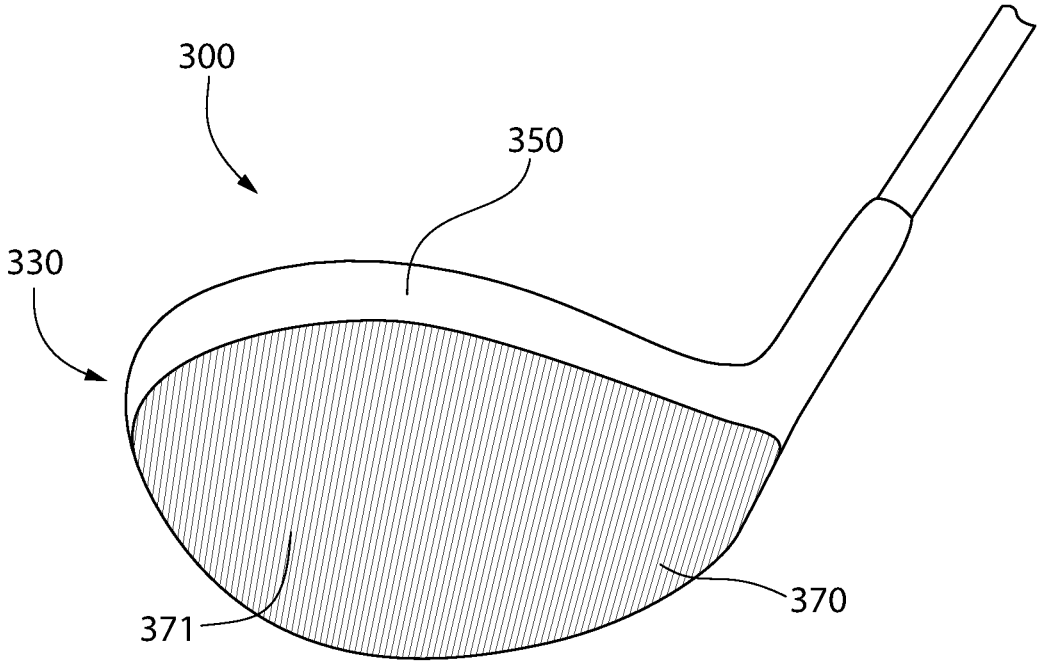
FIG. 9 is a front view of a head of a golf club in accordance with yet another embodiment of the present invention.
Figure 10:
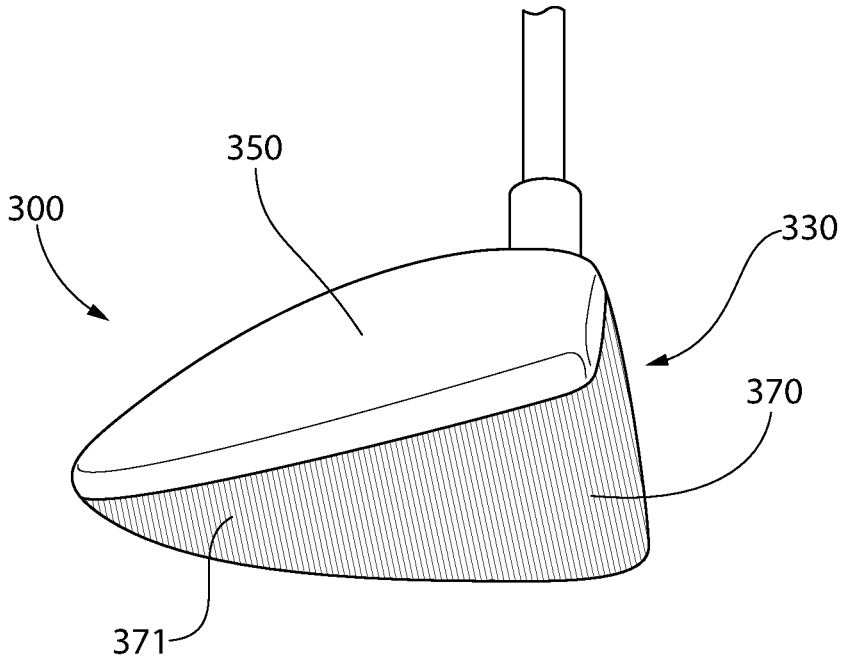
FIG. 10 is a side view of the head of the golf club of FIG. 9.

FIGS. 9 and 10 illustrate a golf club 300 in accordance with yet another embodiment of the present invention. The golf club 300 is identical to the golf club 100 except that the type of club is different. Specifically, the golf club 100 described above is an iron, and specifically a 9-iron, whereas the golf club 300 is a driver. The golf club 300 comprises a head 330 that includes a first portion 350 formed of a rigid material and a second portion 370 formed of a resilient material. In this embodiment, the resilient material is a plurality of bristles 371 similar to that which was described above with regard to the golf club 100. However, the resilient material could alternatively be a compressible material such as those described above with regard to the golf club 200. The details described above with reference to the golf club 100 are equally applicable to the golf club 300 and thus these details will not be repeated herein in the interest of brevity. It should merely be understood that any type of golf club can be manufactured using the teachings set forth herein whereby a portion of the head of the golf club is formed of a rigid material and a portion of the head of the golf club is formed of a resilient material.

While the invention has been described with respect to specific examples including presently preferred modes of carrying out the invention, those skilled in the art will appreciate that there are numerous variations and permutations of the above described systems and techniques. It is to be understood that other embodiments may be utilized, and structural and functional modifications may be made without departing from the scope of the present invention. Thus, the spirit and scope of the invention should be construed broadly as set forth in the appended claims.

What is claimed is:

1. A golf club comprising:

a head comprising a face, a rear surface opposite the face, and a peripheral surface extending between the face and the rear surface, the head further comprising:

a first portion having a top end and a bottom end, the top end forming a top portion of the peripheral surface; and a second portion comprising a plurality of bristles extending from the bottom end of the first portion and terminating in a distal end that forms an entirety of a bottom portion of the peripheral surface, wherein the plurality of bristles form an exposed portion of the face and an exposed portion of the rear surface that extends from the bottom end of the first portion to the bottom portion of the peripheral surface; and wherein the face has a surface area, and wherein the second portion of the head forms at least 50% of the surface area of the face and wherein the plurality of bristles have varying lengths measured from the bottom end of the first portion of the head to the distal end of the second portion of the head.

2. The golf club according to claim 1 wherein the first portion of the head forms a first portion of the face and a first portion of the rear surface and wherein the second portion of the head forms a second portion of the face and a second portion of the rear surface.

3. The golf club according to claim 1 wherein the peripheral surface of the head comprises a distal portion that extends between and transitions smoothly into the top and bottom portions, and wherein the first portion of the head forms a first portion of the distal portion and the second portion of the head forms a second portion of the distal portion.

4. The golf club according to claim 1 wherein the first portion of the head is formed from a rigid material selected from the group consisting of wood, metal, and hard plastic.

5. The golf club according to claim 1 wherein the second portion of the head is fixedly coupled to the first portion of the head.

6. The golf club according to claim 1 wherein the first portion of the head has a maximum height and the second portion of the head has a maximum height, and wherein the maximum height of the second portion is greater than the maximum height of the first portion.

7. The golf club according to claim 1 further comprising a handle coupled to the head, the handle extending along a longitudinal axis, wherein the head has a main portion located between a reference plane that is tangent to a front surface of the handle and a distal portion of the peripheral surface of the head, and wherein within the main portion the second portion of the head has a minimum height measured along a line parallel to the longitudinal axis that is equal to or greater than a height of the first portion of the head measured along the line.

8. The golf club according to claim 1 wherein the bottom portion of the peripheral surface has a rounded contour.

9. The golf club according to claim 1 wherein the first and second portions of the head collectively form a shape that corresponds to a shape of a traditional golf club head.

10. The golf club according to claim 1 wherein the first and second portions of the head have a collective mass that corresponds to a mass of a traditional golf club head.

11. The golf club according to claim 1 further comprising a rounded transition region between the bottom portion of the peripheral surface of the head and a distal portion of the peripheral surface of the head, and wherein the sole and the rounded transition region are formed entirely from the second portion of the head.

12. A golf club comprising:

a head comprising:

a face and a rear surface opposite the face a first portion comprising a top end and a bottom end opposite the top end, the top end of the first portion forming a top portion of the head; and a second portion coupled to and extending from the bottom end of the first portion to a distal end, wherein the distal end is convex; the second portion having a length measured from the bottom end of the first portion to the distal end of the second portion, and wherein the second portion is exposed along the face and the rear surface along an entirety of the length of the second portion;

wherein the first portion of the head is formed from wood, metal, or plastic and the second portion of the head is formed from a plurality of flexible bristles.

13. The golf club according to claim 12 wherein the face has a surface area and the rear surface has a surface area, and wherein the second portion forms at least 50% of the surface area of the face and at least 50% of the surface area of the rear surface.

14. The golf club according to claim 12 wherein the first portion of the head has a length measured from the top end of the first portion to the bottom end of the first portion, and wherein the length of the second portion is greater than the length of the first portion.

* * * * *